US009759219B2

(12) United States Patent
Tiainen et al.

(10) Patent No.: US 9,759,219 B2
(45) Date of Patent: Sep. 12, 2017

(54) FAN APPARATUS AND COOLED ELECTRICAL ASSEMBLY

(71) Applicant: ABB OY, Helsinki (FI)

(72) Inventors: Jari-Petri Tiainen, Riihimäki (FI); Niko Björkman, Klaukkala (FI); Johannes Pylvänen, Helsinki (FI)

(73) Assignee: ABB Oy, Helsinki (FI)

( * ) Notice: Subject to any disclaimer, the term of this patent is extended or adjusted under 35 U.S.C. 154(b) by 317 days.

(21) Appl. No.: 14/597,881

(22) Filed: Jan. 15, 2015

(65) Prior Publication Data

US 2015/0204338 A1 Jul. 23, 2015

(30) Foreign Application Priority Data

Jan. 17, 2014 (EP) ..... 14151536

(51) Int. Cl.

*F04D 17/16* (2006.01)
*F04D 25/16* (2006.01)
*F04D 29/42* (2006.01)

(52) U.S. Cl.

CPC ..... *F04D 17/162* (2013.01); *F04D 17/16* (2013.01); *F04D 25/166* (2013.01); *F04D 29/4226* (2013.01)

(58) Field of Classification Search

CPC ..... F04D 17/00; F04D 17/08; F04D 17/16; F04D 17/105; F04D 17/12; F04D 17/162; F04D 17/127; F04D 17/166

USPC ..... 415/60

See application file for complete search history.

(56) References Cited

U.S. PATENT DOCUMENTS 8,333,547 B2 * 12/2012 Hsu ..... F04D 17/16 415/60
2008/0063532 A1 3/2008 Hsu et al.
2011/0150651 A1 6/2011 Zha et al.

FOREIGN PATENT DOCUMENTS

| | | | |
|---|---|---|---|
| CN | 102108980 | A | 6/2011 |
| CN | 1504647 | A | 6/2014 |
| DE | 295 04 886 | U1 | 7/1995 |
| GB | 948169 | A | 1/1964 |
| JP | 2013245634 | A * | 12/2013 |

OTHER PUBLICATIONS

JP 2013245634 A Machine Translation. JPO Website Accessed Jan. 18, 2017.*

European Search Report mailed on Jun. 17, 2014 for European Application No. 14151536.1.

(Continued)

*Primary Examiner* — Richard Edgar

(74) *Attorney, Agent, or Firm* — Taft Stettinius & Hollister LLP

(57) ABSTRACT

A fan apparatus is disclosed having a first fan and a second fan, both of which are centrifugal fans. Impellers of the first fan and the second fan can be located adjacent one another and adapted to rotate in opposite directions. A first outlet opening (ot1) provided on a housing of the first fan can be located relative to a second outlet opening (ot2) provided on a housing of the second fan such that a flow pattern of the first fan overlaps at least partially with a flow pattern of the second fan when viewed from a direction of a rotation axis of an impeller of the first fan.

13 Claims, 3 Drawing Sheets

(56) References Cited

OTHER PUBLICATIONS

Chinese Office Action; Chinese Patent Office; Chinese Patent Application No. 201510020556.1 dated Sep. 2, 2016; 7 pgs.
English Translation of Chinese Office Action; Chinese Patent Office; Chinese Patent Application No. 201510020556.1 dated Sep. 2, 2016; 9 pgs.

* cited by examiner

FAN APPARATUS AND COOLED ELECTRICAL ASSEMBLY

RELATED APPLICATION

This application claims priority under 35 U.S.C. §119 to European Patent Application No. 14151536.1 filed in Europe on Jan. 17, 2014, the entire content of which is hereby incorporated by reference in its entirety.

FIELD

The present disclosure relates to a fan apparatus, and to a cooled electrical assembly which includes the fan apparatus. It is known in the art to use a centrifugal fan for cooling an electrical assembly. A flow pattern of a known centrifugal fan is unsymmetrical causing temperature differences between electrical components of the electrical assembly.

SUMMARY

A fan apparatus is disclosed, comprising: a first fan and a second fan, both of which are centrifugal fans, wherein the first fan has: a first housing and a first impeller with a plurality of first blades, the first housing being provided with a first inlet opening for a first inlet flow and a first outlet opening for a first outlet flow, the first impeller having a first radius and being rotatably mounted in the first housing for rotation around a first rotation axis in a first direction of rotation, and being configured for providing the first inlet flow and the first outlet flow, each of the plurality of first blades having a first blade width; and wherein the second fan has: a second housing and a second impeller with a plurality of second blades, the second housing being provided with a second inlet opening for a second inlet flow and a second outlet opening for a second outlet flow, the second impeller having a second radius and being rotatably mounted in the second housing for rotation around a second rotation axis in a second direction of rotation, and being configured for providing the second inlet flow and the second outlet flow, each of the plurality of second blades having a second blade width, the second rotation axis being substantially parallel with the first rotation axis, with an axial distance between the first impeller and second impeller, an axial direction being defined by the first rotation axis; and wherein: the first direction of rotation is opposite to the second direction of rotation, the second inlet flow has an opposite direction relative to the first inlet flow, a distance between the first rotation axis and the second rotation axis is less than or equal to three times the first radius and an axial distance between the first blades and the second blades is less than or equal to three times the first blade width, the first outlet opening is located relative to the second outlet opening such that a flow pattern of the first outlet flow will overlap at least partially with a flow pattern of the second outlet flow when viewed from a direction of the first rotation axis; and the first impeller and second impeller are located between the first inlet opening and second inlet opening in the axial direction.

A fan apparatus is also disclosed, comprising: a first fan and a second fan, both of which are centrifugal fans, wherein the first fan has: a first housing and a first impeller with a plurality of first blades, the first housing being provided with a first inlet opening for a first inlet flow and a first outlet opening for a first outlet flow, the first impeller having a first radius and being rotatably mounted in the first housing for rotation around a first rotation axis in a first direction of rotation, and being configured for providing the first inlet flow and the first outlet flow, each of the plurality of first blades having a first blade width; wherein the second fan has: a second housing and a second impeller with a plurality of second blades, the second housing being provided with a second inlet opening for a second inlet flow and a second outlet opening for a second outlet flow, the second impeller having a second radius and being rotatably mounted in the second housing for rotation around a second rotation axis in a second direction of rotation, and being configured for providing the second inlet flow and the second outlet flow, each of the plurality of second blades having a second blade width, the second rotation axis being substantially parallel with the first rotation axis; wherein: the first direction of rotation is opposite to the second direction of rotation, a distance between the first rotation axis and the second rotation axis is less than or equal to three times the first radius and an axial distance between the first blades and the second blades is less than or equal to three times the first blade width, the first outlet opening is located relative to the second outlet opening such that a flow pattern of the first outlet flow will overlap at least partially with a flow pattern of the second outlet flow when viewed from the direction of the first rotation axis; and wherein: the distance between the first rotation axis and second rotation axis is less than a sum of the first radius and second radius such that the first impeller and second impeller overlap each other when viewed from the direction of the first rotation axis.

BRIEF DESCRIPTION OF THE DRAWINGS

In the following, features and advantages disclosed herein will be described in greater detail by way of preferred exemplary embodiments with reference to the attached drawings, in which.

DETAILED DESCRIPTION

An exemplary fan apparatus is disclosed which has a more uniform flow pattern than a known centrifugal fan.

Exemplary embodiments are based on the realization that by placing two centrifugal fans which rotate in opposite directions adjacent one another it is possible to provide a combined flow pattern that is relatively uniform.

An exemplary advantage of a fan apparatus as disclosed herein is that a flow pattern thereof is more uniform than a flow pattern of an individual centrifugal fan. Therefore the fan apparatus as disclosed can facilitate reducing temperature differences between electrical components of a cooled electrical assembly.

Figure 1:
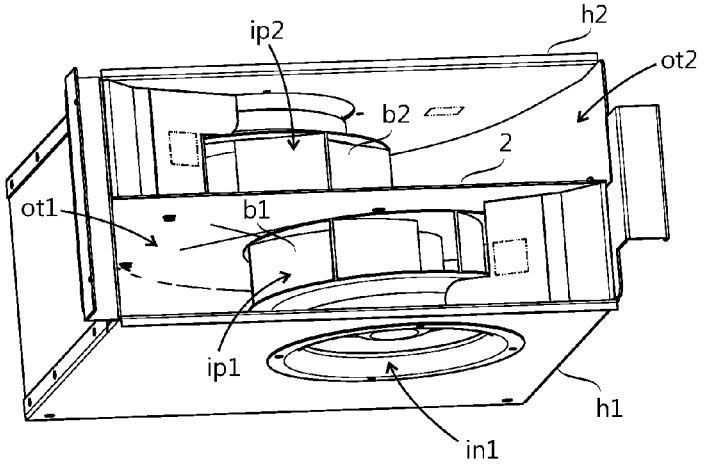
FIG. 1 shows a fan apparatus according to an exemplary embodiment.

FIG. 1 shows an exemplary fan apparatus having a first fan and a second fan, both of which are centrifugal fans. The first fan has a first housing h1 and a first impeller ip1 with a plurality of first blades b1. The first housing h1 is provided with a first inlet opening in1 for a first inlet flow and a first outlet opening ot1 for a first outlet flow. The first impeller ip1 has a first radius $R_1$ and is rotatably mounted in the first housing h1 for rotation around a first rotation axis $A_1$ in a first direction of rotation, and is adapted for providing the first inlet flow and the first outlet flow. Each of the plurality of first blades b1 has a first blade width $W_1$.

The second fan has a second housing h2 and a second impeller ip2 with a plurality of second blades b2. The second housing h2 is provided with a second inlet opening in2 for a second inlet flow and a second outlet opening ot2 for a second outlet flow. The second outlet opening ot2 is identical to the first outlet opening ot1. The second impeller ip2 has a second radius $R_2$ and is rotatably mounted in the second housing h2 for rotation around a second rotation axis $A_2$ in a second direction of rotation which is opposite to the first direction of rotation. The second impeller ip2 is adapted for providing the second inlet flow and the second outlet flow. Each of the plurality of second blades b2 has a second blade width $W_2$. The second rotation axis $A_2$ is substantially parallel with the first rotation axis $A_1$.

The first outlet opening ot1 is located relative to the second outlet opening ot2 such that a flow pattern of the first outlet flow overlaps partially with a flow pattern of the second outlet flow when viewed from the direction of the first rotation axis $A_1$. In other words the flow patterns of the first outlet flow and the second outlet flow overlap at a common plane on which they have been projected.

The second housing h2 is similar to the first housing h1 in order to provide substantially identical first outlet flow and second outlet flow. The second housing h2 is integrated with the first housing h1 such that there is a single wall 2 between the first impeller ip1 and the second impeller ip2.

Figure 2:
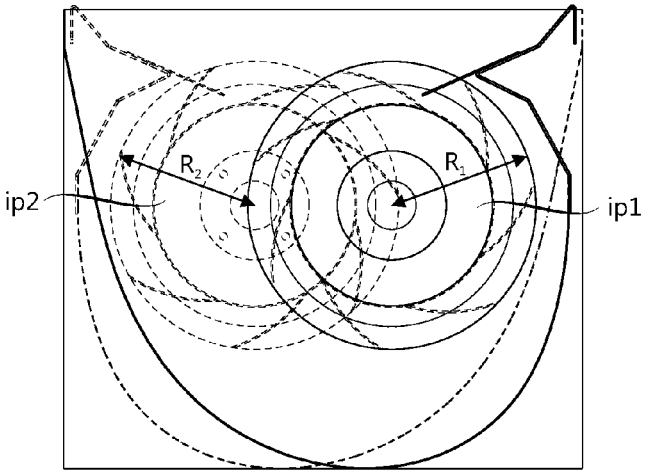
FIG. 2 shows inside structure of the fan apparatus of FIG. 1.

FIG. 2 shows an exemplary inside structure of the fan apparatus of FIG. 1 as seen from a direction of the first rotation axis $A_1$. FIG. 2 shows that a distance between the first rotation axis $A_1$ and the second rotation axis $A_2$ is roughly equal to the first radius $R_1$ and that the first radius $R_1$ is equal to the second radius $R_2$. In an alternative exemplary embodiment a radius of a first impeller may be larger than a radius of a second impeller. For example, a radius of a first impeller may be 25% larger than a radius of a second impeller.

In an exemplary fan apparatus as disclosed herein, a distance between a first rotation axis and a second rotation axis is less than or equal to three times a first radius of a first impeller. In an exemplary embodiment, the first rotation axis and the second rotation axis coincide. In other words the first impeller and the second impeller may be adapted to rotate around a common rotation axis while the first impeller rotates in an opposite direction compared with the second impeller.

Figure 3:
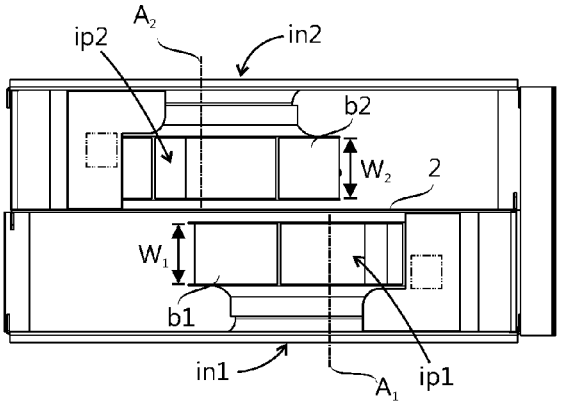
FIG. 3 shows the fan apparatus of FIG. 1 from above.

FIG. 3 shows the fan apparatus of FIG. 1 from above, from direction perpendicular to the first rotation axis $A_1$ and the second rotation axis $A_2$. FIG. 3 shows that the first blade width $W_1$ is equal to the second blade width $W_2$. Also other dimensions of the first impeller ip1 and the second impeller ip2 are equal such that the first impeller ip1 is identical to the second impeller ip2. In an embodiment a first fan is a separate device from a second fan, and the first fan is identical to the second fan.

An axial distance between the first blades b1 and the second blades b2 is roughly half the first blade width $W_1$. In an alternative exemplary embodiment an axial distance between first blades and second blades is less than or equal to three times the first blade width.

The substantially parallel first rotation axis $A_1$ and second rotation axis $A_2$ define an axis plane. Both the first rotation axis $A_1$ and the second rotation axis $A_2$ are substantially located on the axis plane. The first outlet opening ot1 and the second outlet opening ot2 are entirely located on a same side of the axis plane. In FIG. 2 the first outlet opening ot1 and the second outlet opening ot2 are entirely located on upper side of the axis plane, and the first impeller ip1, whose rotation axis is on the right side compared with the rotation axis of the second impeller ip2, is adapted to rotate clockwise for providing the first outlet flow.

Figure 4:
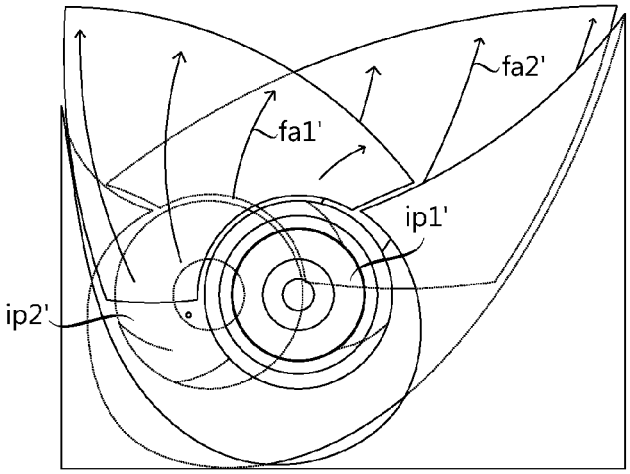
FIG. 4 shows exemplary flow patterns of a first outlet flow and a second outlet flow of a fan apparatus according to another exemplary embodiment of the invention.

FIG. 4 shows flow patterns of a first outlet flow and a second outlet flow of a fan apparatus according to another exemplary embodiment disclosed herein. The fan apparatus of FIG. 4 includes a first fan and a second fan whose impellers are identical. However, the fan apparatus as a whole is unsymmetrical. A second housing h2' of the second fan is different from the first housing h1' of the first fan. A first fan chamber of the first fan has a different geometry compared with geometry of a second fan chamber of the second fan. Therefore the flow pattern of the first fan is different from the flow pattern of the second fan. The flow pattern of the second fan is wider than the flow pattern of the first fan.

In FIG. 4 the flow pattern of the first outlet flow overlaps partially with the flow pattern of the second outlet flow such that overlap angle is approximately 90° seen from a first rotation axis of a first impeller. In an alternative exemplary embodiment the overlap angle may be greater than or equal to 60°. The overlap angle may also be greater than 90°.

Figure 5:
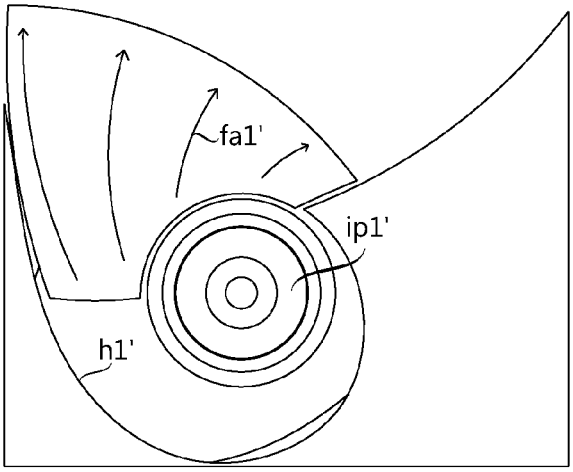
FIG. 5 shows an exemplary flow pattern of the first outlet flow shown in FIG. 4.
Figure 6:
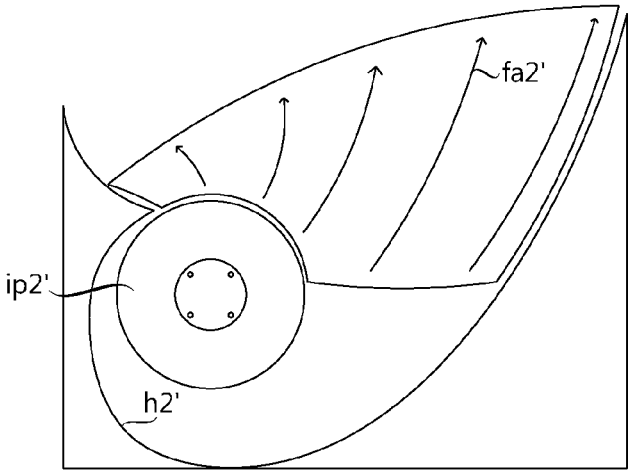
FIG. 6 shows a flow pattern of the second outlet flow shown in FIG. 4.

FIGS. 5 and 6 show the flow patterns of FIG. 4 separately. FIG. 5 shows the flow pattern of the first fan alone, and FIG. 6 shows the flow pattern of the second fan alone. Further, FIGS. 5 and 6 clearly show the difference between the geometry of the first fan chamber of the first fan and the geometry of the second fan chamber of the second fan. The second fan chamber is larger than the first fan chamber, and the second outlet opening is larger than the first outlet opening.

In FIGS. 4 to 6, an intensity of the first outlet flow has been illustrated by first flow arrows fa1', and an intensity of the second outlet flow has been illustrated by second flow arrows fa2'. The flow arrows show that the first outlet flow is strongest at its left edge, and second outlet flow is strongest at its right edge. A combined outlet flow of the fan apparatus is quite even since the first outlet flow and the second outlet flow combine at a central portion of the fan apparatus. The first outlet flow and the second outlet flow combine at a central portion of the fan apparatus because impellers of the first fan and the second fan are adjacent one another, and because the first outlet opening and the second outlet opening are located appropriately.

Figure 7:
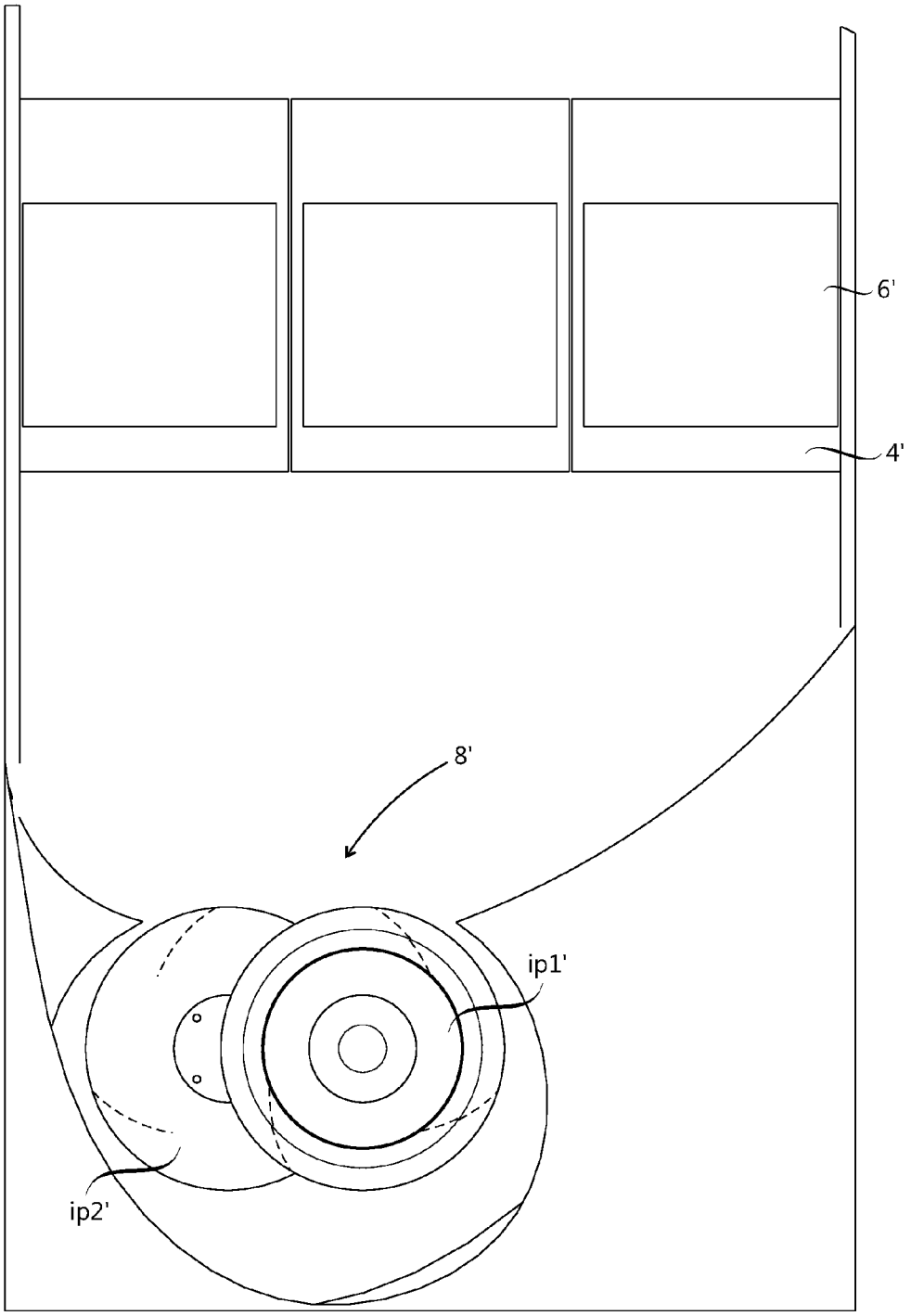
FIG. 7 shows a sectional view of an exemplary cooled electrical assembly containing the fan apparatus of FIG. 4.

FIG. 7 shows a sectional view of a cooled electrical assembly having a circuit board 4' defining a board plane, a plurality of electrical components 6'mounted on a first side of the circuit board 4', and a fan apparatus 8' for cooling the plurality of electrical components 6'. The fan apparatus 8' is similar to the fan apparatus shown in FIG. 4.

In the fan apparatus 8' the first fan and the second fan are located on the first side of the board plane such that the first outlet flow of the first fan and the second outlet flow of the second fan are directed to the plurality of electrical components 6'. A first rotation axis of the first fan and a second rotation axis of the second fan are perpendicular to the board plane. In an alternative exemplary embodiment, the first rotation axis and the second rotation axis are tilted relative to a normal of the board plane. It is also possible to locate the fan apparatus such that a portion of the first outlet flow of the first fan and the second outlet flow of the second fan is directed on a first side of the board plane while the rest of the first outlet flow and the second outlet flow is directed on a second side of the board plane, the second side facing opposite direction relative to the first side.

The electrical components 6' are semiconductor switch components such as insulated-gate bipolar transistors or IGBTs. In alternative exemplary embodiments the cooled electrical components may include other power electronics components such as heat sinks, capacitors or chokes.

If one of the fans of FIG. 7 breaks down, the remaining fan can be configured to be capable of cooling the plurality of electrical components 6' if a maximum power of the cooled electrical assembly is limited to half the nominal power of the cooled electrical assembly. Therefore the cooled electrical assembly has some fault-tolerance.

It will be apparent to a those skilled in the art that inventive concepts as disclosed herein can be implemented in various ways. The invention and its embodiments are not limited to the examples described above but may vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A fan apparatus, comprising: a first fan and a second fan, both of which are centrifugal fans, wherein the first fan has:

a first housing and a first impeller with a plurality of first blades, the first housing being provided with a first inlet opening for a first inlet flow and a first outlet opening for a first outlet flow, the first impeller having a first radius and being rotatably mounted in the first housing for rotation around a first rotation axis in a first direction of rotation, and being configured for providing the first inlet flow and the first outlet flow, each of the plurality of first blades having a first blade width; and wherein the second fan has:

a second housing and a second impeller with a plurality of second blades, the second housing being provided with a second inlet opening for a second inlet flow and a second outlet opening for a second outlet flow, the second impeller having a second radius and being rotatably mounted in the second housing for rotation around a second rotation axis in a second direction of rotation, and being configured for providing the second inlet flow and the second outlet flow, each of the plurality of second blades having a second blade width, the second rotation axis being substantially parallel with the first rotation axis, with an axial distance between the first impeller and second impeller, an axial direction being defined by the first rotation axis; and wherein:

the first direction of rotation is opposite to the second direction of rotation, the second inlet flow has an opposite direction relative to the first inlet flow, a distance between the first rotation axis and the second rotation axis is less than or equal to three times the first radius and an axial distance between the first blades and the second blades is less than or equal to three times the first blade width, the first outlet opening is located relative to the second outlet opening such that a flow pattern of the first outlet flow will overlap at least partially with a flow pattern of the second outlet flow when viewed from a direction of the first rotation axis; and the first impeller and second impeller are located between the first inlet opening and second inlet opening in the axial direction;

wherein the first outlet opening and the second outlet opening are entirely located on a same side of an axis plane defined by the substantially parallel first rotation axis and second rotation axis; and wherein the first impeller and the second impeller are located such that, when viewed from a direction parallel to the first rotation axis such that the first outlet opening and the second outlet opening are entirely located on upper side of the plane of the first and second rotation axes, one of the first impeller and the second impeller whose rotation axis is on a right side compared with the rotation axis of the other impeller, will rotate clockwise for providing a respective outlet flow.

2. A fan apparatus according to claim 1, wherein the flow pattern of the first outlet flow will overlap with the flow pattern of the second outlet flow such that an overlap angle is greater than or equal to 60 .degree. as seen from the first rotation axis.

3. A fan apparatus according to claim 1, wherein the first impeller is identical to the second impeller.

4. A fan apparatus according to claim 3, wherein the second housing is integrated with the first housing such that there is a single wall between the first impeller and the second impeller.

5. A fan apparatus according to claim 3, wherein the first fan is identical to the second fan.

6. A fan apparatus according to claim 1, wherein the distance between the first rotation axis and second rotation axis is less than a sum of the first radius and second radius such that the first impeller and second impeller overlap each other when viewed from the direction of the first rotation axis.

7. A cooled electrical assembly, comprising:

a plurality of electrical components; and a fan apparatus for cooling the plurality of electrical components, wherein the fan apparatus is a fan apparatus according claim 1.

8. A fan apparatus comprising:

a first fan and a second fan, both of which are centrifugal fans, wherein the first fan has:

a first housing and a first impeller with a plurality of first blades, the first housing being provided with a first inlet opening for a first inlet flow and a first outlet opening for a first outlet flow, the first impeller having a first radius and being rotatably mounted in the first housing for rotation around a first rotation axis in a first direction of rotation, and being configured for providing the first inlet flow and the first outlet flow, each of the plurality of first blades having a first blade width; wherein the second fan has:

a second housing and a second impeller with a plurality of second blades, the second housing being provided with a second inlet opening for a second inlet flow and a second outlet opening for a second outlet flow, the second impeller having a second radius and being rotatably mounted in the second housing for rotation around a second rotation axis in a second direction of rotation, and being configured for providing the second inlet flow and the second outlet flow, each of the plurality of second blades having a second blade width, the second rotation axis being substantially parallel with the first rotation axis; wherein:

the first direction of rotation is opposite to the second direction of rotation, a distance between the first rotation axis and the second rotation axis is less than or equal to three times the first radius and an axial distance between the first blades and the second blades is less than or equal to three times the first blade width, the first outlet opening is located relative to the second outlet opening such that a flow pattern of the first outlet flow will overlap at least partially with a flow pattern of the second outlet flow when viewed from the direction of the first rotation axis; and wherein:

the distance between the first rotation axis and second rotation axis is less than a sum of the first radius and second radius such that the first impeller and second impeller overlap each other when viewed from the direction of the first rotation axis;

wherein the first outlet opening and the second outlet opening are entirely located on a same side of an axis plane defined by the substantially parallel first rotation axis and second rotation axis;

wherein the first impeller and the second impeller are located such that, when viewed from a direction parallel to the first rotation axis such that the first outlet opening and the second outlet opening are entirely located on upper side of the plane of the first and second rotation axes, one of the first impeller and the second impeller whose rotation axis is on a right side compared with the rotation axis of the other impeller, will rotate clockwise for providing respective outlet flow.

9. A fan apparatus according to claim 8, wherein the flow pattern of the first outlet flow will overlap with the flow pattern of the second outlet flow such that overlap angle is greater than or equal to 60 .degree. as seen from the first rotation axis.

10. A fan apparatus according to claim 8, wherein the first impeller is identical to the second impeller.

11. A fan apparatus according to claim 10, wherein the second housing is integrated with the first housing such that there is a single wall between the first impeller and the second impeller.

12. A fan apparatus according to claim 10, wherein the first fan is identical to the second fan.

13. A cooled electrical assembly comprising:

a plurality of electrical components; and a fan apparatus for cooling the plurality of electrical components, wherein the fan apparatus is a fan apparatus according to claim 8.

* * * * *